US008646880B2

(12) United States Patent
Munakata

(10) Patent No.: US 8,646,880 B2
(45) Date of Patent: Feb. 11, 2014

(54) LIQUID EJECTING HEAD AND LIQUID EJECTING APPARATUS

(75) Inventor: Manabu Munakata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/431,759

(22) Filed: Mar. 27, 2012

(65) Prior Publication Data

US 2012/0249685 A1 Oct. 4, 2012

(30) Foreign Application Priority Data

Mar. 29, 2011 (JP) ..... 2011-071871

(51) Int. Cl.
*B41J 2/045* (2006.01)

(52) U.S. Cl.
USPC ..... 347/68; 347/70; 347/71

(58) Field of Classification Search
USPC ..... 347/68–72, 47
See application file for complete search history.

(56) References Cited

U.S. PATENT DOCUMENTS

| | | | | |
|---|---|---|---|---|
| 6,076,244 | A | 6/2000 | Okumura et al. | |
| 6,494,566 | B1 | 12/2002 | Kishino et al. | |
| 2007/0284967 | A1 * | 12/2007 | Shimada et al. | 310/328 |
| 2009/0115822 | A1 * | 5/2009 | Sugahara et al. | 347/70 |

FOREIGN PATENT DOCUMENTS

| | | | |
|---|---|---|---|
| JP | 10-286956 | A | 10/1998 |
| JP | 10-305574 | A | 11/1998 |
| JP | 11-147318 | A | 6/1999 |

* cited by examiner

*Primary Examiner* — Henok Legesse
(74) *Attorney, Agent, or Firm* — Kilpatrick Townsend & Stockton LLP

(57) ABSTRACT

A charge accumulated on an insulative nozzle plate flows into the ink with which nozzle openings and pressure generation chambers are filled and reaches a vibration plate. The charge that has reached the vibration plate is driven out therethrough because the vibration plate is made of a conductive ceramic material and is grounded. Therefore, it is possible to obtain an ink jet recording head in which insulation breakdown of the vibration plate caused by the charge accumulated on the vibration plate is suppressed from occurring and a driving circuit is suppressed from being damaged.

16 Claims, 4 Drawing Sheets

LIQUID EJECTING HEAD AND LIQUID EJECTING APPARATUS

BACKGROUND

1. Technical Field

The present invention relates to liquid ejecting heads and liquid ejecting apparatuses using the liquid ejecting heads.

2. Related Art

Liquid ejecting heads that eject liquid through nozzle openings are applied in, for example, image recording apparatuses as liquid ejecting apparatuses such as printers, liquid ejecting apparatuses used in the manufacture of color filters for liquid crystal display devices and the like, and so on.

There is provided a type of liquid ejecting head in which a voltage is applied to a piezoelectric element formed on a surface of a vibration plate in accordance with a driving signal from a driving circuit so that the piezoelectric element is caused to bend and deform to eject a liquid droplet. This type of liquid ejecting head includes a vibration plate, a pressure generation chamber, part of which is formed by the vibration plate, nozzle openings, and a head unit having a manifold. The head unit is manufactured by layering the vibration plate, a flow channel formation substrate, a nozzle plate in which the nozzle openings are formed, and so on.

For example, an ink jet recording head formed of ceramic plate members that are calcined and connected in an integrated manner is well-known as a liquid ejecting head (for example, see JP-A-10-286956).

In the case where a calcination process is carried out in an integrated manner using a vibration plate, a flow channel formation substrate and a nozzle plate as insulative ceramic materials, the insulative ceramic materials can be electrically charged by a piezoelectric element, static electricity and the like. As a result, insulation breakdown can be caused to occur in the vibration plate, or a driving circuit can be damaged by the electrical charges through an electrode of the piezoelectric element, and so on.

SUMMARY

An advantage of some aspects of the invention is to provide a liquid ejecting head and a liquid ejecting apparatus using the liquid ejecting head, which can be realized in embodiments or application examples described hereinafter.

Application Example 1

A liquid ejecting head that includes: a flow channel formation substrate made of a ceramic material in which pressure generation chambers and separation walls of liquid flow channels are formed; a vibration plate made of a conductive ceramic material that is disposed on one surface of the flow channel formation substrate and configures part of the pressure generation chambers and the liquid flow channels; piezoelectric elements that are formed on the vibration plate facing the pressure generation chambers with the vibration plate being sandwiched, and are respectively provided with a pair of electrodes; a driving circuit connected to the electrodes; and a nozzle plate made of an insulative ceramic material in which nozzle openings communicating with the pressure generation chambers are formed.

According to this application example, a charge accumulated on the insulative nozzle plate flows into the liquid with which the nozzle openings and the pressure generation chambers are filled and reaches the vibration plate. The charge that has reached the vibration plate is driven out therethrough because the vibration plate is made of a conductive ceramic material and is grounded. Therefore, it is possible to obtain a liquid ejecting head in which the driving circuit is suppressed from being damaged by the inflow of the accumulated charge.

Application Example 2

In the aforementioned liquid ejecting head, it is preferable for the vibration plate to be used as a grounded side of the pair of electrodes.

With this application example, because the vibration plate is used as an electrode of the grounded side, any additional electrode is not needed to be formed. Accordingly, it is possible to obtain a liquid ejecting head which has a simple structure and can be manufactured with ease.

Application Example 3

In the aforementioned liquid ejecting head, it is preferable for the flow channel formation substrate, the vibration plate and the nozzle plate to be calcined together in an integrated manner.

With this application example, because the flow channel formation substrate, the vibration plate and the nozzle plate are made of ceramic and are calcined together in an integrated manner, it is possible to obtain a liquid ejecting head in which less positional deviation is generated by heat shrinkage among the flow channel formation substrate, the vibration plate and the nozzle plate, and which can be assembled with ease.

Application Example 4

A liquid ejecting apparatus that includes any one of the aforementioned liquid ejecting heads.

According to this application example, a liquid ejecting apparatus having the effects described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in detail hereinafter with reference to the drawings. Note that, in order to facilitate understanding of the descriptions, the drawings are illustrated such that part of each of the drawings is omitted, or configurations and the like of the embodiments are heightened, and so on.

The following description exemplifies a case in which an ink jet recording head 100 as a liquid ejecting head is installed in a printer 1000 as an image recording apparatus, which is a liquid ejecting apparatus.

Figure 1:
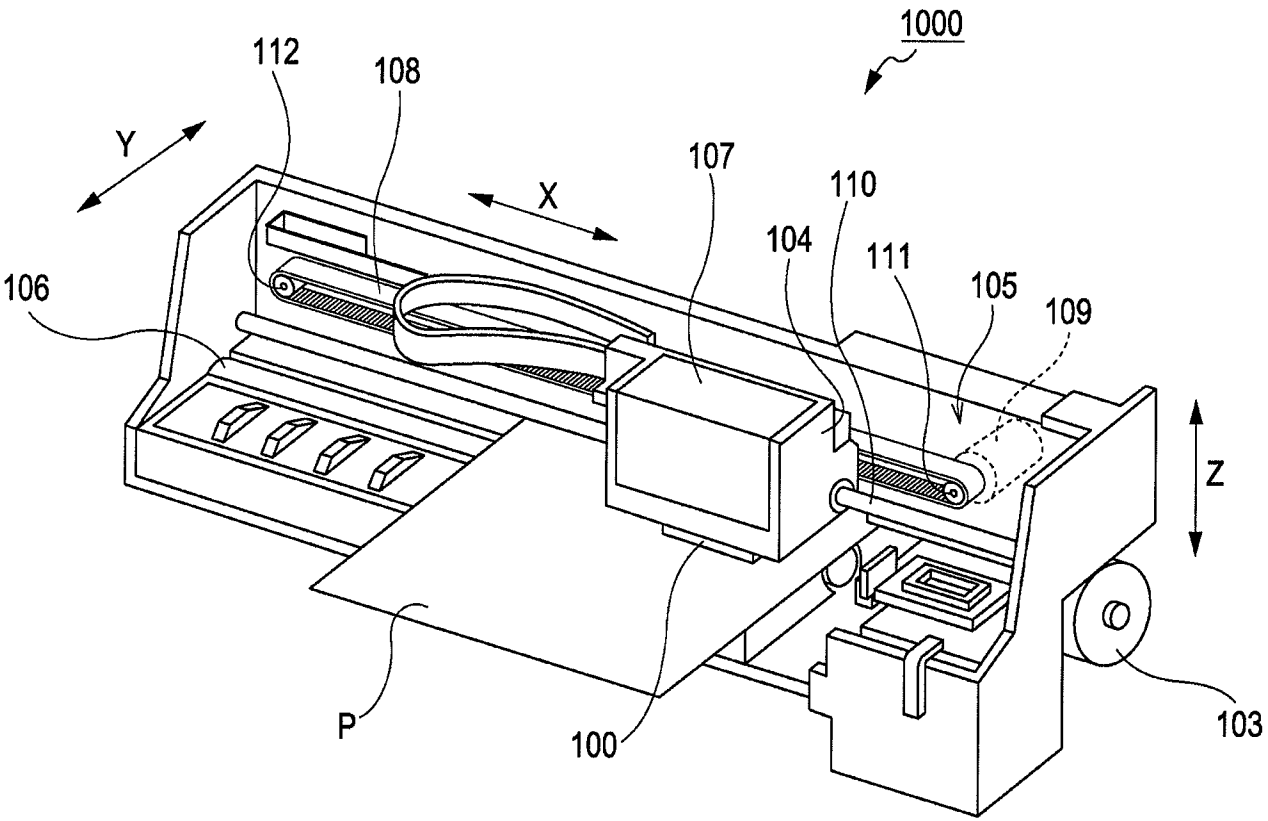
FIG. 1 is a perspective view schematically illustrating a printer according to an embodiment of the invention.

FIG. 1 is a view illustrating the general configuration of the printer 1000. In FIG. 1, an X-direction indicates a main scanning direction along which a carriage 104 moves, and a Y-direction indicates a sub scanning direction along which a recording medium P is transported. A Z-direction is a direction that is orthogonal to both the X-direction and the Y-direction.

As shown in FIG. 1, the printer 1000 includes the ink jet recording head 100, the carriage 104, a carriage movement mechanism 105, a platen roller 106, and an ink cartridge 107.

The ink jet recording head 100 is attached to a side facing the recording medium P of the carriage 104 (the lower surface thereof in the Z-direction in FIG. 1) and ejects ink as a liquid droplet on the surface of the recording medium P. The carriage movement mechanism 105 includes a timing belt 108, a driving pulley 111, a slave pulley 112 and a motor 109. The timing belt 108, to which the carriage 104 is fixed, is stretched upon between the driving pulley 111 and the slave pulley 112. The driving pulley 111 is connected to the output shaft of the motor 109.

Accordingly, when the motor 109 operates, the carriage 104 moves back and forth in the X-direction, which is the main scanning direction, while being guided along a guide rod 110 provided in the printer 1000.

The platen roller 106 receives a driving force from a motor 103 so as to transport the recording medium P in the Y-direction, which is the sub scanning direction. The ink cartridge 107 stores ink and is detachably mounted on the carriage 104. The ink cartridge 107 supplies ink to the ink jet recording head 100.

The printer 1000 configured as described above ejects ink as droplets from the ink jet recording head 100 that is attached to the carriage 104 while causing the carriage 104 to be moved by the carriage movement mechanism 105 back and forth in the X-direction and also causing the recording medium P to be transported by the platen roller 106 in the Y-direction, thereby making it possible to record an image and the like on the recording medium P such as a recording sheet.

Figure 2:
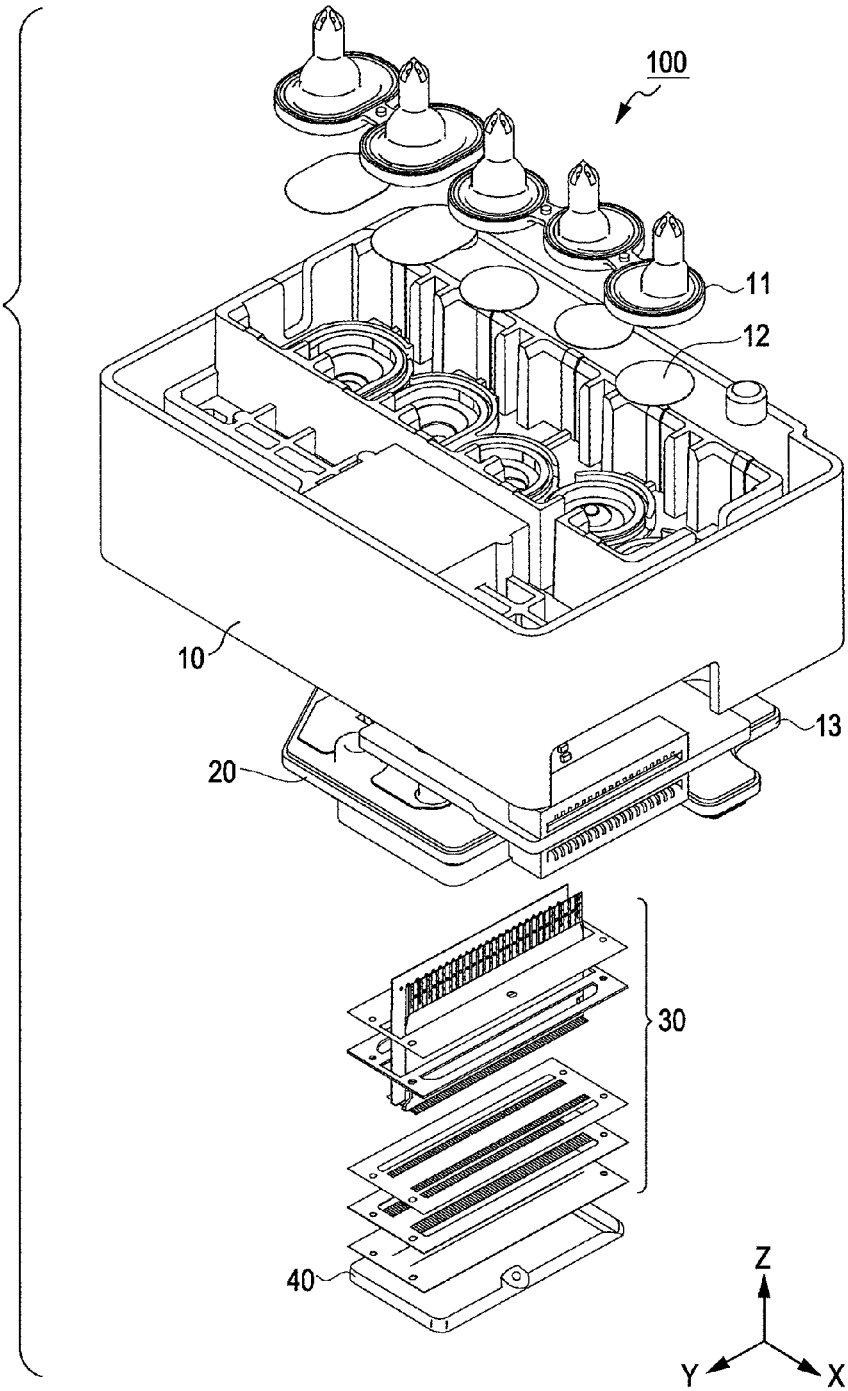
FIG. 2 is an exploded perspective view schematically illustrating an ink jet recording head.

FIG. 2 is an exploded perspective view schematically illustrating the ink jet recording head 100. Also in FIG. 2, the X-direction representing the main scanning direction, the Y-direction representing the sub scanning direction, and the Z-direction orthogonal to both the X-direction and the Y-direction are illustrated.

In FIG. 2, the ink jet recording head 100 includes amounting plate 10, a case head 20, a head unit 30, and a cover case 40. The head unit 30 is disposed at the bottom portion of the case head 20 and is placed in the cover case 40. Although only one head unit 30 and one cover case 40 are each illustrated in the drawing, the recording head may be configured with combination of a plurality of head units 30 and a plurality of cover cases 40.

The mounting plate 10 includes needles 11 that introduce ink from the ink cartridge 107 as shown in FIG. 1, filters 12 that filter the ink, and so on. The case head 20 has a case head side-substrate 13 for connecting a flexible board 37 which is explained later, and so on.

Figure 3:
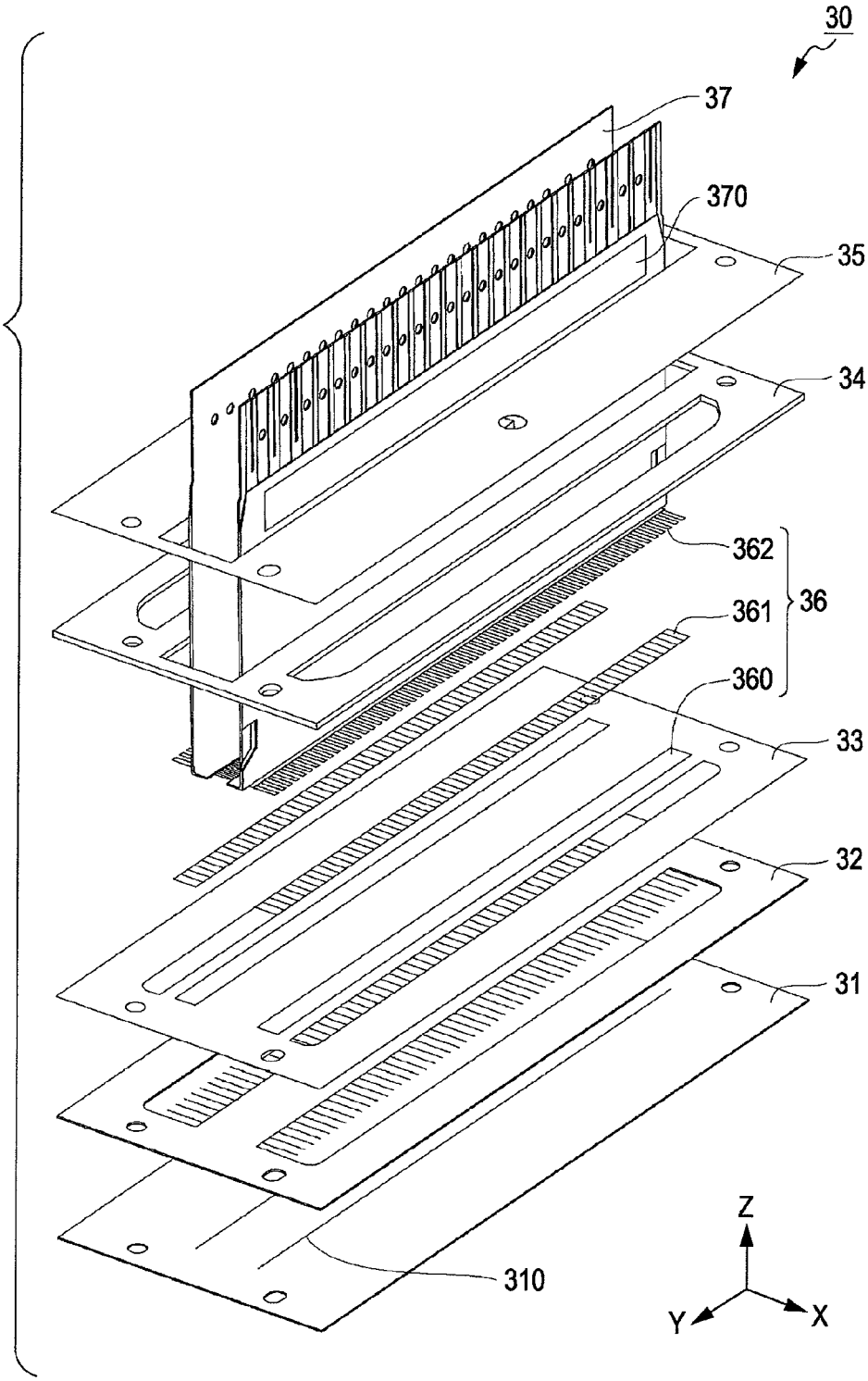
FIG. 3 is an exploded perspective view schematically illustrating a head unit.
Figure 4:
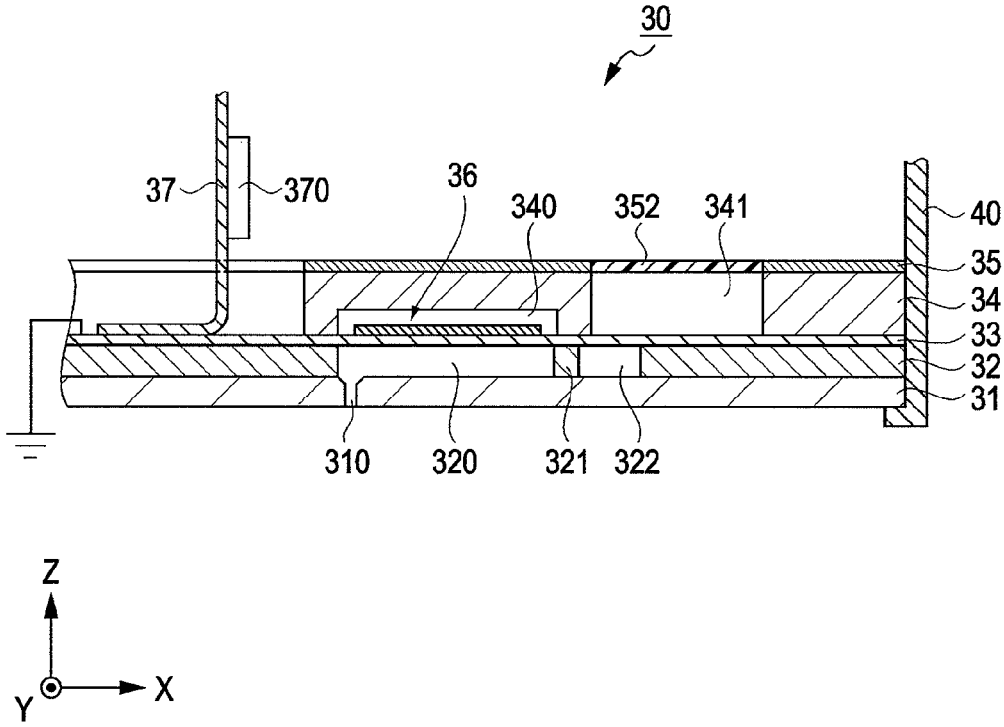
FIG. 4 is a cross-sectional view illustrating the main portion of the head unit and a cover case.

FIG. 3 is an exploded perspective view schematically illustrating the head unit 30, and FIG. 4 is a descriptive cross-sectional view of the main portion of the head unit 30 and the cover case 40. Also in FIGS. 3 and 4, the X-direction representing the main scanning direction, the Y-direction representing the sub scanning direction, and the Z-direction orthogonal to both the X-direction and the Y-direction are illustrated. In FIGS. 3 and 4, the head unit 30 has a nozzle plate 31 at a position opposing the recording medium P as shown in FIG. 1. Nozzle openings 310 for ejecting ink therethrough are formed in the nozzle plate 31. The nozzle openings 310 are provided at a pitch in accordance with a dot formation density.

A flow channel formation substrate 32 for supplying ink to the nozzle plate 31, a vibration plate 33, a reservoir plate 34 and a compliance substrate 35 are layered in sequence on the nozzle plate 31.

A communication hole serving as a pressure generation chamber 320, an ink supply channel 321 communicating with the pressure generation chamber 320, and a communication portion 322 are provided in the flow channel formation substrate 32.

The cross-section of the pressure generation chamber 320 along the X-direction, which is the widthwise direction of the ink jet recording head 100, has a rectangular shape. Note that the X-direction is orthogonal to the Y-direction, which is the lengthwise direction of the ink jet recording head 100. The pressure generation chamber 320 is formed to be elongate in the X-direction, which is the widthwise direction of the ink jet recording head 100. Note that the stated X-direction is regarded as the lengthwise direction of the pressure generation chamber 320. The cross-section thereof is not limited to a rectangular shape, and can be, for example, a trapezoid shape.

The communication portion 322 is formed in an area outside of the pressure generation chamber 320 in the lengthwise direction thereof in the flow channel formation substrate 32; further, the communication portion 322 and each pressure generation chamber 320 communicate with each other through the ink supply channel 321 that serves as a liquid supply channel and is provided for each pressure generation chamber 320. The ink supply channel 321 is formed to be narrower in width than the pressure generation chamber 320, and maintains the fluid resistance of ink that flows into the pressure generation chamber 320 from the communication portion 322 at a constant value.

The vibration plate 33 is layered on the flow channel formation substrate 32 and configures part of the pressure generation chamber 320.

Piezoelectric elements 36 that bend and vibrate when a voltage is applied thereto are formed on the vibration plate 33. In FIG. 3, the piezoelectric elements 36 include a lower electrode 360 that is grounded and serves as a common electrode, piezoelectric materials 361, and upper electrodes 362 serving as individual electrodes.

The piezoelectric elements 36 are formed on a surface of the vibration plate 33 that is the opposite side to a surface thereof facing the pressure generation chambers 320 so as to cover the pressure generation chambers 320 with the vibration plate 33 therebetween, and are arranged along a nozzle row direction, corresponding to each of the pressure generation chambers 320.

As the lower electrode 360, a metal such as platinum and iridium, or an oxidized metal such as lanthanum nickelate (LNO) and strontium ruthenate (SrRuO) can be used, for example. Meanwhile, as the upper electrode 362, a metal such as platinum and iridium can be used, for example. These electrodes can be formed by sputtering, vapor deposition or the like.

Lead zirconate titanate can be used as the piezoelectric material 361.

A membrane of the piezoelectric material 361 can be manufactured by what is known as a sol-gel method. The sol-gel method is a method that so-called sol in which a metal organic material is dissolved and dispersed in a catalyst is coated and dried to become gel; thereafter the gel is calcined at a high temperature to obtain the membrane of the piezoelectric element 361 which is made of metal oxide.

Note that the method for manufacturing the membrane is not limited to the sol-gel method, and a metal-organic decomposition (MOD) method or the like may be employed. Further, the method for manufacturing the membrane of the piezoelectric material 361 is not limited to these liquid-phase methods, and a method using a vapor deposition technique such as sputtering and the like may be employed for manufacturing the membrane of the piezoelectric material 361.

The nozzle plate 31, the flow channel formation substrate 32 and the vibration plate 33 are made of ceramic plates such as alumina, zirconia and the like, and are calcined together in an integrated manner so as to be connected. Here, a conductive ceramic material is used for the vibration plate 33, whereas an insulative ceramic material is used for the nozzle plate 31 and the flow channel formation substrate 32. Note that the vibration plate 33 is grounded. The grounding can be implemented via the printer 1000. Since the vibration plate 33 is conductive and grounded, it can be used as a common electrode of the piezoelectric elements 36; in the embodiment, the vibration plate 33 can be used as the lower electrode 360.

A material in which conductive particles are dispersed into an insulative ceramic material such as alumina, zirconia or the like can be used as a conductive ceramic material. Silicon particles, for example, can be used as the conductive particles.

The calcination process in an integrated manner can be carried out as described below.

For example, machining operations such as cutting, punching and the like are performed on a green sheet (sheet material before being calcined) so as to form a necessary communication hole and the like, by which precursors of the nozzle plate 31, the flow channel formation substrate 32 and the vibration plate 33 are respectively formed in sheet form.

Then, by layering and calcining the sheet-formed precursors, the sheet-formed precursors are integrated into one ceramic sheet. In this case, because the sheet-formed precursors are calcined together in an integrated manner, any special adhesion process is not needed. In addition, excellent sealing characteristics can be achieved at connection surfaces of the sheet-formed precursors.

In FIG. 4, a piezoelectric element holding portion 340 that protects the piezoelectric element 36 and a communication hole that serves as a reservoir portion 341 communicating with the communication portion 322 are formed in the reservoir plate 34, and are adhered to the vibration plate 33. The communication portion 322 and the reservoir portion 341 are combined and are called a manifold. The compliance substrate 35 is adhered to a surface of the reservoir plate 34 that is the opposite side to a surface thereof adhered to the vibration plate 33. A region of the compliance substrate 35 that corresponds to the reservoir portion 341 is configured of a flexible membrane 352 which absorbs the fluctuation in pressure generated in the manifold.

In FIG. 3, the flexible board 37 penetrates through the reservoir plate 34 and the compliance plate 35 so as to be connected with the lower electrode 360 and the upper electrodes 362 of the piezoelectric elements 36.

A chip on film (COF) board can be used as the flexible board 37.

The flexible board 37 is connected with the case head side-substrate 13 disposed on the case head 20 as shown in FIG. 2, and is so configured as to receive a power supply from the case head side-substrate 13. A driving circuit 370 that performs a control operation in which driving signals from the case head side-substrate 13 as shown in FIG. 2 are selectively supplied to the piezoelectric elements 36 is mounted on the flexible board 37.

The inkjet recording head 100 has a configuration in which the piezoelectric elements 36 bend and vibrate when a voltage is applied thereto so that ink is ejected through the nozzle openings 310 of the nozzle plate 31 by the vibration motion of the piezoelectric elements 36.

According to the embodiment described above, the following effects can be achieved.

(1) A charge accumulated on the insulative nozzle plate 31 flows into the ink with which the nozzle openings 310 and the pressure generation chambers 320 are filled and reaches the vibration plate 33. The charge that has reached the vibration plate 33 is driven out therethrough because the vibration plate 33 is made of a conductive ceramic material and is grounded. Therefore, it is possible to obtain the ink jet recording head 100 in which the driving circuit 370 is suppressed from being damaged by the inflow of the accumulated charge.

(2) Because the vibration plate 33 is used as the lower electrode 360 of the grounded side, any additional electrode is not needed to be formed. Accordingly, it is possible to obtain the ink jet recording head 100 which has a simple structure and can be manufactured with ease.

(3) Because the flow channel formation substrate 32, the vibration plate 33 and the nozzle plate 31 are made of ceramic and are calcined together in an integrated manner, it is possible to obtain the ink jet recording head 100 in which less positional deviation is generated by heat shrinkage among the flow channel formation substrate 32, the vibration plate 33 and the nozzle plate 31, and which can be assembled with ease.

(4) The printer 1000 having the aforementioned effects can be obtained.

With this invention, different kinds of variations can be made aside from the embodiment described above.

For example, the flow channel formation substrate 32 may be formed of a conductive ceramic material. Also in this case, the lower electrode 360 and the vibration plate 33 can be used as the common electrode.

Note that in the aforementioned examples, a case in which the liquid ejecting head is the ink jet recording head 100 is described. However, the liquid ejecting head of the invention can be used as, for example, a coloring material ejecting head used in the manufacture of color filters for liquid crystal displays and the like, an electrode material ejecting head used in the formation of electrodes for organic EL displays, surface emitting displays (FEDs) and the like, a bioorganic matter ejecting head used in the manufacture of biochips, and so on.

Thus far, the printer 1000 has been described as an example of the liquid ejecting apparatus according to the invention. However, the liquid ejecting apparatus according to the invention can also be used in industrial fields. As a liquid (liquid material) to be ejected in this case, a material in which viscosity of various functional materials is adjusted to an appropriate degree by a solvent, a dispersion medium or the like can be employed. The liquid ejecting apparatus of the invention can be appropriately used as, in addition to an image recording apparatus such as the exemplified printer, a coloring material ejecting apparatus used in the manufacture of color filters for liquid crystal displays and the like, a liquid material ejecting apparatus used in the formation of electrodes, color filters and the like for organic EL displays, surface emitting displays (FEDs), electrophoretic displays and the like, and a bioorganic material ejecting apparatus used in the manufacture of biochips.

The entire disclosure of Japanese Patent Application No. 2011-071871, filed Mar. 29, 2011 is expressly incorporated by reference herein.

What is claimed is:

1. A liquid ejecting head comprising:

a flow channel formation substrate made of a ceramic material in which pressure generation chambers and separation walls of liquid flow channels are formed;

a vibration plate made of a conductive ceramic material that is disposed on one surface of the flow channel formation substrate and configures part of the pressure generation chambers and the liquid flow channels;

piezoelectric elements that are formed on the vibration plate facing the pressure generation chambers with the vibration plate being sandwiched, and are respectively provided with a pair of electrodes;

a driving circuit connected to the electrodes; and a nozzle plate made of an insulative ceramic material in which nozzle openings communicating with the pressure generation chambers are formed.

2. A liquid ejecting head comprising:

a flow channel formation substrate made of a ceramic material in which pressure generation chambers and separation walls of liquid flow channels are formed;

a vibration plate made of a conductive ceramic material that is disposed on one surface of the flow channel formation substrate and configures part of the pressure generation chambers and the liquid flow channels;

piezoelectric elements that are formed on the vibration plate, and are respectively provided with a pair of electrodes;

a driving circuit connected to the electrodes; and a nozzle plate made of an insulative ceramic material in which nozzle openings communicating with the pressure generation chambers are formed.

3. The liquid ejecting head according to claim 2, wherein the vibration plate is used as a grounded side of the pair of electrodes.

4. The liquid ejecting head according to claim 2, wherein the flow channel formation substrate, the vibration plate and the nozzle plate are calcined together in an integrated manner.

5. A liquid ejecting apparatus comprising: the liquid ejecting head according to claim 2.

6. The liquid ejecting head according to claim 2, wherein the conductive ceramic material is made of a material in which conductive particles are dispersed into the insulative ceramic material.

7. A liquid ejecting apparatus comprising: the liquid ejecting head according to claim 3.

8. A liquid ejecting apparatus comprising: the liquid ejecting head according to claim 4.

9. A liquid ejecting head comprising:

a flow channel substrate comprising a ceramic material and defining pressure generation chambers and separation walls of liquid flow channels therein;

a vibration plate comprising a conductive ceramic material that is disposed on a surface of the flow channel substrate and partly defines the pressure generation chambers and the liquid flow channels;

one or more piezoelectric elements disposed on the vibration plate, wherein each of the piezoelectric elements is provided with a pair of electrodes;

a driving circuit connected to the electrodes; and a nozzle plate comprising an insulative ceramic material and defining nozzle openings communicating with the pressure generation chambers.

10. The liquid ejecting head of claim 9, wherein the vibration plate is a grounded one of the pair of electrodes.

11. The liquid ejecting head of claim 9, wherein the flow channel substrate, the vibration plate, and the nozzle plate are calcined together in an integrated manner.

12. The liquid ejecting head of claim 9, wherein the conductive ceramic material is a material comprising conductive particles dispersed into the insulative ceramic material.

13. The liquid ejecting head of claim 9, wherein the nozzle plate is made of alumina or zirconia.

14. The liquid ejecting head of claim 9, wherein the flow channel substrate is made of alumina or zirconia.

15. The liquid ejecting head of claim 12, wherein the insulative ceramic material is alumina or zirconia.

16. The liquid ejecting head of claim 12, wherein the conductive particles are silicon particles.

* * * * *